US011365457B1

(12) United States Patent
Chavda et al.

(10) Patent No.: US 11,365,457 B1
(45) Date of Patent: Jun. 21, 2022

(54) LIONFISH LEATHER AND PREPARATION THEREOF

(71) Applicant: Quintessence Marine Inc., Sanibel, FL (US)

(72) Inventors: Aarav Chavda, Sanibel, FL (US); Roland Salatino, Sanibel, FL (US)

(73) Assignee: Quintessence Marine Inc., Sanibel, FL (US)

( * ) Notice: Subject to any disclaimer, the term of this patent is extended or adjusted under 35 U.S.C. 154(b) by 0 days.

(21) Appl. No.: 17/397,629

(22) Filed: Aug. 9, 2021

(51) Int. Cl.

| | |
|---|---|
| ***C14C 13/00*** | (2006.01) |
| ***C14C 1/04*** | (2006.01) |
| ***C14B 7/00*** | (2006.01) |
| ***C14C 3/28*** | (2006.01) |
| ***C14C 1/08*** | (2006.01) |

(52) U.S. Cl.
CPC ..... *C14C 13/00* (2013.01); *C14B 7/00* (2013.01); *C14C 1/04* (2013.01); *C14C 1/08* (2013.01); *C14C 3/28* (2013.01)

(58) Field of Classification Search
CPC .. C14C 13/00; C14C 1/04; C14C 1/08; C14C 3/28; C14B 7/00
See application file for complete search history.

(56) References Cited

U.S. PATENT DOCUMENTS 2,700,590 A * 1/1955 Biery ..... C14C 13/00 8/94.12
4,379,708 A * 4/1983 Rego ..... C14C 3/28 8/94.12
4,755,186 A * 7/1988 Ernst ..... C14C 13/00 8/94.12

FOREIGN PATENT DOCUMENTS

CN 105961562 * 9/2016 ..... A22C 25/08

OTHER PUBLICATIONS

Tomlinson, Gina. Ypou could get paid to help get rid of an invasive species off the Southwest Florida coast. Feb. 12, 2021 https://www.winknews.com/2021/02/12/you-could-get-paid-to-help-get-rid-of-an-invasive-species-off-the-southwest-florida-coast/.*

* cited by examiner

*Primary Examiner* — Amina S Khan
(74) *Attorney, Agent, or Firm* — Smith, Gambrell & Russell LLP

(57) ABSTRACT

Systems and methods for preparing fish leather, which may comprise lionfish leather, are described. A method of making lionfish leather may comprise cutting, using one or more guidelines, at least a portion of a lionfish body, wherein the guidelines are configured to facilitate removal of skin from of the lionfish body; removing, using the one or more guidelines, the skin from the lionfish body, wherein the removed skin defines a cut skin pattern based on at least the guidelines; and subjecting the removed skin to at least a tanning process to provide a lionfish leather.

7 Claims, 8 Drawing Sheets

500

502

600

604 602

LIONFISH LEATHER AND PREPARATION THEREOF

BACKGROUND

*Pterois radiata* (clear-fin lionfish), *Pterois volitans* (red lionfish), and *Pterois miles* (devil firefish) are three of several species of the genus *Pterois* known commonly as lionfish. *P. miles* and *P. volitans* are two of most invasive species destroying marine ecosystems in the Gulf of Mexico, the Caribbean Sea and the Western North Atlantic, as well as invading the Mediterranean Sea from their native Indo-Pacific region. Their introduction has been especially harmful to coral reefs since these species can reduce the number of other fish species living in the reefs significantly in a short period of time due to their venom, their efficiency as predators, and the lack of predators or parasites to keep their numbers in check.

Improvements are needed.

SUMMARY

This disclosure relates to fish leather such as lionfish leather. The present disclosure relates to fish leather substrates having unique cut patterns and methods for making cut fish leather. The present disclosure relates to lion fish leather substrates and methods for making lionfish leather.

One general aspect includes a method of making lionfish leather. The method of making lionfish leather includes removing at least a portion of scales from a lionfish body to form an at least partially descaled lionfish body; cutting, using one or more guidelines, at least a portion of the at least partially descaled lionfish body, where the guidelines are configured to separate one or more spines from a skin of the at least partially descaled lionfish body and/or facilitate removal of the skin from the body; peeling, using the one or more guidelines, the skin from the lionfish body, where the peeled skin defines a cut skin pattern based on at least the guidelines; brining the peeled skin in a first brine; removing at least a portion of flesh from the peeled skin after the first brine; salting the peeled skin; and subjecting the peeled skin to at least a tanning process to provide a lionfish leather, where the tanning process may include removing at least a portion of the salt from the peeled skin, exposing the peeled skin to a first tanning agent, and exposing the peeled skin to a second tanning agent different from the first tanning agent.

One general aspect includes a method of making lionfish leather. The method of making lionfish leather includes cutting, using one or more guidelines, at least a portion of a lionfish body, where the guidelines are configured to facilitate removal of skin from the lionfish body; removing, using the one or more guidelines, the skin from the lionfish body, where the removed skin defines a cut skin pattern based on at least the guidelines; and subjecting the removed skin to at least a tanning process to provide a lionfish leather, where the tanning process may include exposing the removed skin to a first tanning agent and exposing the removed skin to a second tanning agent different from the first tanning agent.

One general aspect includes a method of making lionfish leather. The method of making lionfish leather includes cutting, using one or more guidelines, at least a portion of a lionfish body, where the guidelines are configured to facilitate removal of skin from the lionfish body and/or separate one or more spines from a skin of the lionfish body; removing, using the one or more guidelines, the skin from the lionfish body, where the removed skin defines a cut skin pattern based on at least the guidelines; and subjecting the removed skin to at least a tanning process to provide a lionfish leather.

One general aspect includes a method of making lionfish leather. The method of making lionfish leather includes removing at least a portion of the scales from a lionfish body to form a descaled lionfish body; cutting one or more guideline cuts in the descaled lionfish body; peeling, using the one or more guideline cuts, a skin from the lionfish body; and tanning the skin to provide a lionfish leather.

One general aspect includes a method of harvesting lionfish. The method of harvesting lionfish includes offering a hunting incentive for the hunting of lionfish, where the hunting incentive may include a weight component and a shot location component; receiving lionfish from one or more hunters, sorting the received lionfish based at least on body size and shot location, and rendering payment to the one or more hunters based on the hunting incentive and the received lionfish.

One general aspect includes a method for protecting coral reefs from over-predation by lionfish. The method includes determining a location for lionfish meeting a certain density threshold; providing a hunting incentive for hunting of lionfish at or near the location, where the hunting incentive may include a weight component and a shot location component; receiving lionfish from one or more hunters; sorting the received lionfish based at least on body size and shot location; and rendering payment to the one or more hunters based on the hunting incentive and the received lionfish.

One general aspect includes a method for creating lionfish skin leather. The method includes harvesting a lionfish by spear fishing; removing scales from a body of the lionfish, cutting a skin of the body of the lionfish to maximize skin a surface area, subjecting the skin to a tanning process.

One general aspect includes a method for creating leather from lionfish skin.

The method includes cutting a skin of a lionfish in a pattern which maximizes a skin surface area; peeling the skin from a body of the fish, treating the skin to form a leather substrate.

BRIEF DESCRIPTION OF THE DRAWINGS

The following drawings show generally, by way of example, but not by way of limitation, various examples discussed in the present disclosure. In the drawings.

DETAILED DESCRIPTION

Figure 1:
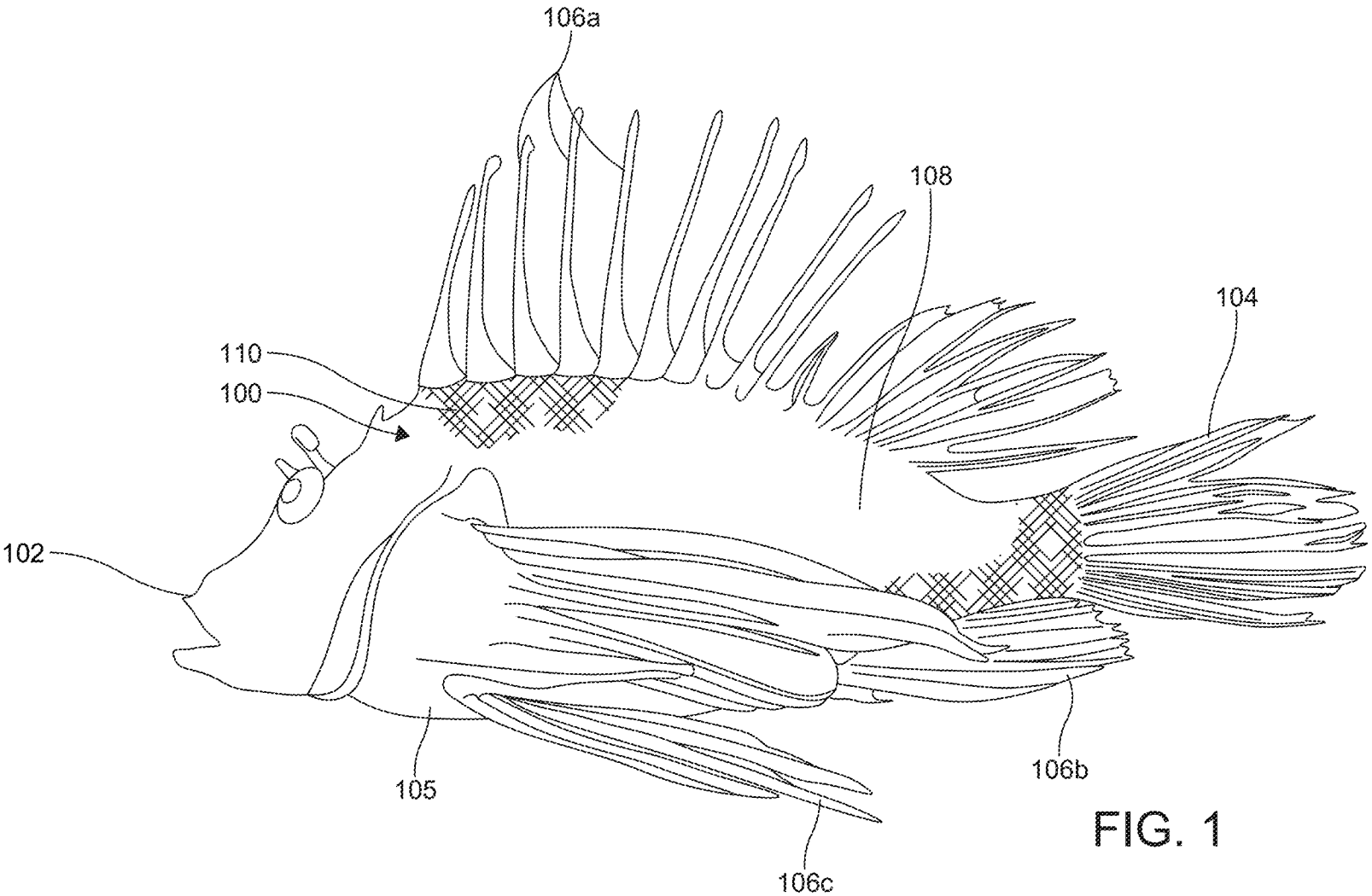
FIG. 1 illustrates an example lionfish in accordance with the present disclosure.

Certain fish, such as lionfish (genus *Pterois*) are invasive and may be detrimental to the environment. As an example, lionfish may have a negative impact on the development of coral reef or other sea life.

The present disclosure relates to systems, methods, and useful articles that may address one or more issues presented by invasive fish, such as lionfish. As an illustrative example, a single lionfish can kill up to ~80% of life on any coral reef it touches by eliminating juvenile wildlife in the ecosystem and reducing the number of living creatures reaching maturity. Each female spawns up to 6 M eggs per year. Lionfish have eighteen venomous spines and no natural predators in the Atlantic. In certain instances, lionfish kill the juvenile native reef fish that maintain the native algae. Without these native reef fish, the algae overgrows and suffocates the coral. When coral dies, then the surrounding life that is supported by the coral may also die.

The present disclosure relates to the harvesting and processing of fish such as lionfish. As an example, the discrete harvesting of lionfish may have a direct positive environmental benefit to the environments that were being impacted by the invasive lionfish. Moreover, the harvested lionfish may be processed into usable product. Lionfish may be processed for the fish meat or fillet. Additionally or alternatively, lionfish may be processed to provide a fish skin leather material that may be used in other products. Processing of a fish may be dependent on the desired output of the fish products. As described herein, certain process steps such as de-scaling and cutting, for example, may be optimized to maximize the output and/or quality of fish meat from each fish. Alternatively, certain processes steps such as de-scaling and cutting, for example, may be optimized to maximize the surface area and/or quality of removed fish skin from each fish. As an example, the output or quality of the fish meat may be sacrificed in order to provide better quality or a larger surface area of fish skin harvested from each of the processed lionfish. Such a trade-off may be counterintuitive to a market driven by fish meat. Indeed, the present disclosure relates to a novel market for fish skin leather comprising lionfish skin.

Conventionally, divers have not been commercially or professionally hunting lionfish at least because of the lack of a continuous institutional buyer. Thus, hunting lionfish has been fragmented and infrequent, if it was done at all. As a result, lionfish have been spreading unchecked across many reef structures, sensitive fish nurseries, and protected marine areas.

Most fish caught in U.S. waters are strictly regulated with some combination of hunting caps, size limits, high license price thresholds, and a limited number of licenses issued per year. Due to the destructive potential of the invasive lionfish, certain exceptions for lionfish hunting may be offered. However, additional incentives may also be needed to address the lionfish population in certain areas. The present disclosure relates to incentive programs customized for lionfish. Lionfish are relatively small and often require more involved hunting processes due to at least their size, depth of habitat, defensive spines, and surrounding environments. Thus, the market for lionfish meat may not be enough incentive to motivate the discrete hunting of lionfish.

The present disclosure relates to lionfish hunting incentives that may promote the hunting of lionfish over other genus or species of fish. As an illustrative example, by setting a high price for lionfish shot (e.g., speared) in the head (headshot) relative to those shot in the body (e.g., via one or more body shots), divers have an incentive to prefer headshots over body shots. Headshots may be more humane (faster and less painful to the fish). Headshots may be more valuable because the damages neither the skin nor the fillet, both of which have value in the present disclosure. For similar economic reasons, there is a preference for larger fish since larger fish produce more leather and more meat. Pricing structures may be leveraged to incentivize divers to hunt for lionfish instead of native fish and may also incentivize them to shoot larger lionfish. Thus, divers are provided with an incentive to shoot larger lionfish more cleanly, in larger volume, and more frequently.

Other incentives may also be employed. For instance, increasing the price of the fish for greater amounts of fish sold at one time or for set quantities delivered consistently on consecutive weeks help give divers incentives to become regular suppliers. As an example, if a diver sells on a regular basis, such as weekly, they may be offered higher prices. These incentives give divers good reasons to prefer larger lionfish and to elect to use headshots, as well as providing them with good reasons to hunt more fish and to hunt more frequently.

Incentives may be structured to encourage commercial divers to target lionfish primarily and to encourage recreational divers to become pseudo-commercial divers. Recreational divers may now shoot lionfish whenever they go out, either to make a profit or at least to cover the costs for their own recreation.

Incentives may apply to various harvesting processes such as electric zappers, traps, submersible robots, and/or spearfishing. But spearfishing is extremely expensive and thus is typically reserved in the industry for large fish (>15 lbs). It is so counterintuitive to commercially hunt small fish in this manner that other fisheries have completely abandoned the practice for all but the largest fish (such as grouper) and refuse to dive for lionfish altogether. In addition, conventional tanning process have not contemplated tanning small fish (e.g., ~400-450 mm in length, ~2.5 lbs/fish or less, less than 450 mm in length, between 200-450 mm in length, between 0.75 and 2.5 lbs/fish, between 0.2 and 1 lbs/fish, between 0.2 and 0.75 lbs/fish). The present disclosure relates to lionfish leather and the creation of the same. The present disclosure relates to methods of creating a market for the hunting and harvesting of smaller fish. The present disclosure also relates to a novel process for creating leather from a small fish.

Additionally or alternatively, other harvesting techniques (e.g., live catch, underwater remotely operated vehicle (e.g., submersible robot) spearing, ROV-enabled electrification and suction (stun and trap), ROV-enabled suction (without the electrified stun), active trapping (e.g., a trap that creates an active incentive to aggregate lionfish in an area, such as playing certain acoustic sounds underwater that sound like lionfish mating calls or certain prey types), passive trapping, etc., may be used to preserve the quality of the skins. In particular, methods are contemplated to minimize the spines of one lionfish from piercing the skin of other harvested lionfish. The conventional harvesting of fish does not contemplate such measures to protect the integrity of the skin of the fish used for leather.

The logistics of fish harvest pick-up may provide efficiencies. For example, supply lines may be established to provide a regular pick-up schedule for a region. Inputs relating to the number of hunters and the frequency of hunting may be used to establish updated supply pick-ups. As such, an increase in lionfish harvesting from various regions may be aggregated to result in a larger bulk of fish for downstream processing such as tanning or leather processing.

One or more of the process and methods may be executed via a computer program such as one or more processors configured to execute computer readable medium. A user interface may be used to collect input and/or provide output to a user. As an illustrative example, programs such as rule-based algorithms or machine learning may be used to implement one or more of the inventive processes described herein. The programs or algorithms may be executed locally or via a network and may comprise a software app for handheld devices.

Additionally or alternatively, end-to-end processes for removing lionfish from the sea, while making use of the lionfish as a resource are described herein. As an illustrative example, lionfish skin may be processed into a leather material for use in various articles. Leather processing may include a tanning process. Additionally, Table 1 shows example pre-tanning steps that may be performed. The order of the steps in Table 1 is presented as a non-limiting example. For example, removing scales may occur after a de-liming step. Steps may be removed or added, or re-ordered.

TABLE 1

Pre-tanning process steps

| Step | Examples in Accordance with the Present Disclosure |
|---|---|
| Weigh fish | |
| Sort fish | ≥3 groups |
| Remove scales | Perpendicular, in-line, or against scales |
| Cut fish | Special cuts (guidelines) maximize skin area |
| Peel skin | Sacrifice some flesh for more skin or higher quality skin |
| Chemical Bath 1 | Helps soften flesh for removal; may use a solution made with a combination of water and one or more of alkylbenzene sulfonate, salt, an aqueous-dissolved oil, and/or any surfactant. |
| De-flesh | |
| Chemical Bath 2 | May store in Chemical Bath 2 for between 5 days and 2 weeks, for example |
| Dry | Dry salt, or outdoor clothesline hang dry, or put through an industrial dehydrator, etc. |
| Package & store | |

As an illustrative example, after the lionfish have been hunted and collected, they may be weighed. Lionfish may be sorted, such as being separated into groups based on one or more metrics. Such groupings may comprise at least three lionfish subgroups: large (>0.5 lbs) with no body shots, large with body shots+mediums (0.2-0.51bs), and smalls (less than 0.2 lbs). The fish may be separated into several groups depending on size (e.g. large, medium, and small) and where they have been shot (head vs. body). Other thresholds and groupings may be used. For example, fish may be grouped based on one or more of: length, color, scale size, placement of spear shot, visual skin damage, etc.

The fish may be descaled. Descaling may comprise the removal of scales from the body of the fish using one or more descaling techniques, such as a high-friction fabric, a metal scraper, a descaler, a water jet, and/or a backside of curved metal knife. Other techniques may be used. Water jets may be used to blast the scales off the fish. For descaling using water jets according to the present disclosure the jets may be in line with the grain of the scales or perpendicular to the grain and not be directed against the grain. Blasting the scales in line with the grain is slower and thus more expensive than going against the grain, but preserves the scale pattern.

FIG. 1 shows an example of a body 100 of a lionfish. The body 100 comprises a head 102 and a tail 104 disposed opposite the head. A belly 105 is defined along a bottom of the body 100 between the head 102 and the tail 104. As shown, the lionfish 100 may have a plurality of spines 106. The spines 106 may comprise venomous spines. The spines 106 may be or comprise dorsal spines 106*a*, anal spines 106*b*, pelvic spines 106*c*, or form on other locations of the body 100. At least a portion of the body 100 may be covered with a fish skin 108. The fish skin 108 may be covered in scales 110.

As part of a fish processing method in accordance with the present disclosure, one or more of the spines 106 may be removed from the body 100. As an example, the dorsal spines 106*a* and anal spines 106*b* may be removed. As a further example, all spines may be removed.

Figure 2:
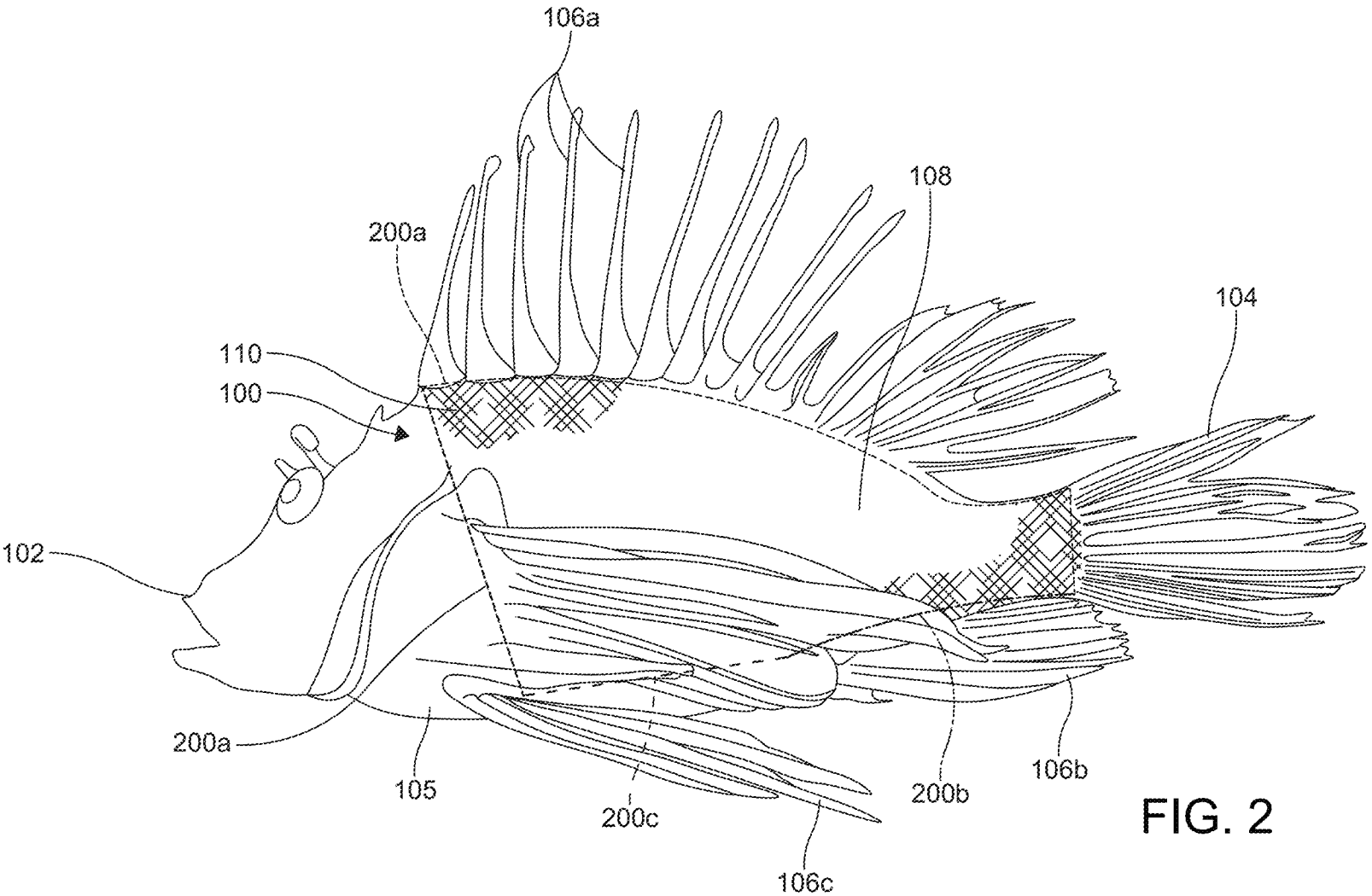
FIG. 2 illustrates cutting guidelines for a lionfish in accordance with the present disclosure.

FIG. 2 illustrates an example cutting process in accordance with the present disclosure. As shown, one or more cutting guidelines 200 may be arranged based on the specific characteristics of the body 100. As an example, the cutting guidelines 200 define a path of a cut across at least a portion of the body. A knife may be used to cut along the cutting guidelines 200 in preparation for skin removal. Other cutting devices may be used. The cutting guidelines 200 may be arranged to cut along at least a portion of the spines 106. As such, cutting along the cutting guidelines 200 may enable removal of the spines 106 from the body or to separate the spines 106 from the skin 108. As an example, the dorsal spines 106*a* and/or the anal spines 106*b* may be cut and separated from the skin 108. Cuts may be made around the tail 104 and/or around the head 102. Other cuts may be made depending on the desired overall shape of the skin, which is described in more detail below. In certain instances, the cutting guidelines 200 for the cuts may be configured to maximize a surface area of the skin to be used. As such, the cuts and peeling may result in sacrifice of fish meat in favor of fewer cuts or holes in the skin.

As a non-limiting example, the cutting guidelines 200 may comprise incisions along an edge of the fish body. Such cutting guidelines 200 may be disposed at a peripheral edge of the fish body to allow for the largest area of skin to be removed from the fish. The incisions may cut through the skin into at least part of the flesh of the fish allowing mechanical separation of the skin from the flesh at the edge of the incision. Then, by peeling from that starting point (i.e., the incision), the skin may be removed from the body.

As a further example, the cutting guidelines 200 may be configured to facilitate a removal of the fish skin by defining one or more of a start and end point (e.g., a line). The cutting guidelines 200 may minimize a scenario where skin being peeled from one end to the other will be torn off from the edge of the fish. The cutting guidelines 200 may minimize a jagged or imperfect tear, straight lines or sharp corners. The cutting guidelines 200 may comprise curved cuts, as sharp corners may be stress concentrators that may later prove to be weak points in the tanning process, and are often where tears happen in the tanning (or re-tanning) drum.

Once cut, the skin 108 may be removed. As an example, the skin 108 may be peeled off, for example, by hand or mechanically. As an illustrative example, a processor may start peeling the skin 108 at the head 102 where an incision was made and peel in downward motions from the spine toward the belly 105 and from the front to the back of the fish body 100. As an illustrative example, peeling the skin 108 off the fish instead of cutting may tear off part of the harvestable fillet and may increase the processing time. However, a peeling process, in accordance with the present disclosure, may enable larger unified pieces of skin 108 and reduces the likelihood of cutting holes in the skin 108. As such, a peeling process may maximize a surface area of the removed skin 108 and may minimize the chance of damaging the skin 108 during processing.

Figure 3A:
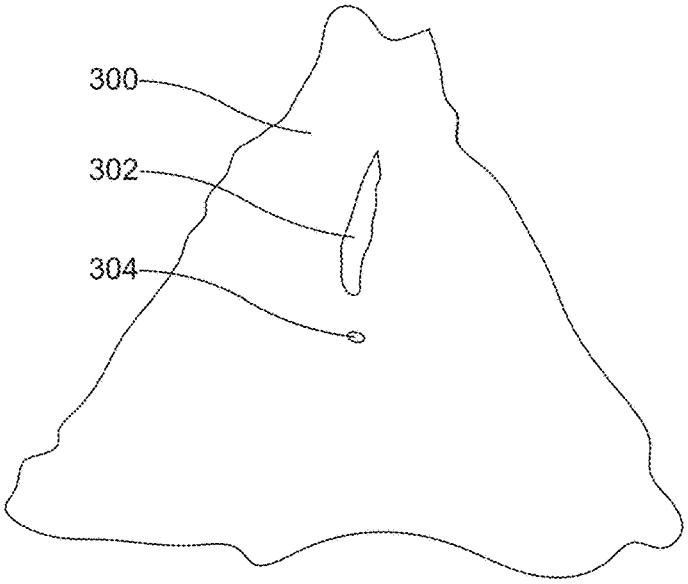
FIG. 3A illustrates an example triangle cut of a lionfish skin using cutting guidelines in accordance with the present disclosure.
Figure 3B:
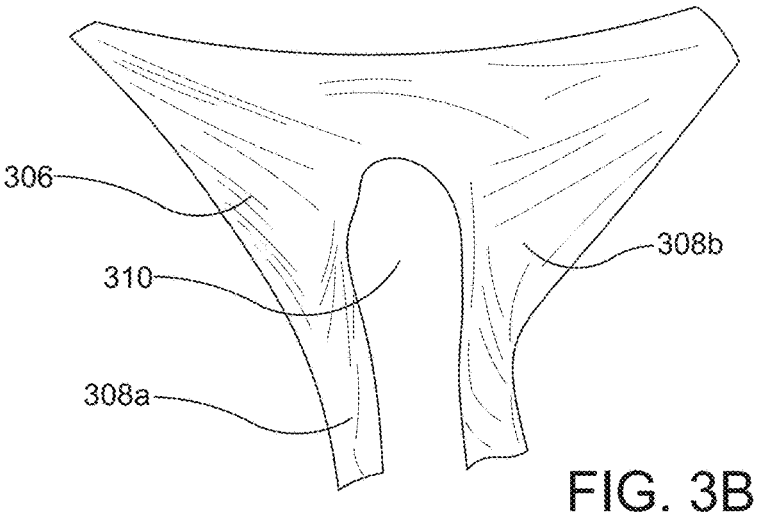
FIG. 3B illustrates an example pants cut of a lionfish skin using cutting guidelines in accordance with the present disclosure.
Figure 3C:
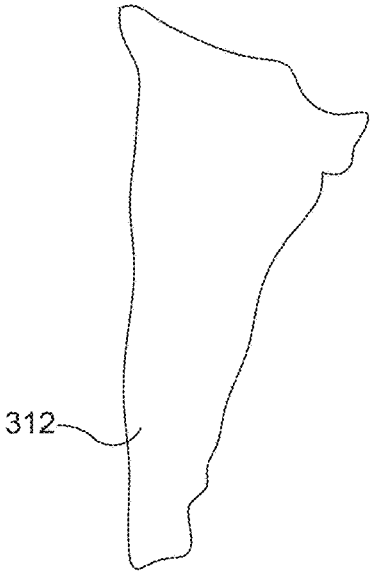
FIG. 3C illustrates an example half-skin cut of a lionfish skin using cutting guidelines in accordance with the present disclosure.

Various cuts, for example, based on a set of guidelines 200, of the skin 108 may be used to result in removed skin patterns. As an illustrative example, guidelines 200*a* may be used to generate a triangle cut pattern (as shown in FIG. 3A). As shown, one or more guidelines 200 (or cuts) may comprise a cut behind the gills of the fish relative to the head 102. As another example, the guidelines 200*a*, 200*b* may be used to generate a pants cut pattern (as shown in FIG. 3B.) As a further example, the guidelines 200*a*, 200*b*, 200*c* may be used to generate a half-skin cut pattern (as shown in FIG. 3C). Other cuts and guidelines may be used. Examples of three such cuts and the removed skin patterns are shown in FIGS. 3A, 3B, and 3C. Other cuts and guidelines 200 may be used.

FIG. 3A shows a triangle cut pattern 300 in accordance with the present disclosure. The triangle cut pattern 300 may comprise a generally triangular shape. As an example, the triangle cut pattern 300 may have the shape of an equilateral triangle. An aperture or hole 302 may be disposed within the triangle cut pattern 300. The hole 302 may be the result of the cutting and removal of the anal spines 106*b* (FIG. 1) from the body 100. The hole 302 may be distinguishable from other holes that may also be created accidentally during the cutting or the peeling operations. Other naturally occurring holes such as the anal hole 304 may be present.

FIG. 3B shows a skin cut in a so-called pants cut pattern 306. The pants cut pattern 306 may divide the fish skin (e.g., fish skin 108 (FIG. 1)) into a left pant leg 308*a* and a right pant leg 308*b*, with a cutout 310 disposed therebetween.

FIG. 3C shows the half skin cut pattern 312. As an example, the half skin cut pattern 312 may be created by completing a cut to separate each of the pant legs from the pants cut pattern 306. The half skin cut pattern 312 may be approximately a side or half of the fish body.

The triangle skin cut pattern 300 may maximize the surface area of each individual fish skin (for each fish). However, the small size of these skins may cause problems during subsequent processing. In the large drums used in parts of the tanning process, the skins may be damaged or tangled together thus inhibiting proper tanning or requiring manual untangling followed by re-processing. Other fish tanners do not have to use the triangle skin cut pattern 300 because the fish they tan are much bigger than lionfish skins. Cutting the skins in the triangle skin cut pattern 300 or "full" cut requires significantly more processing time and increases the labor expenses, but enables removal of a larger amount of skin per fish. Moreover, the triangle cut may sacrifice net fish meat in favor of quality and/or surface area of the fish skin.

After the skin is removed (e.g., peeled) from the fish, there may still be some flesh attached to the skin. The skin and attached flesh may be soaked in chemical bath (e.g., at least 500 g halophile-free salt per liter of water) for at least 30 minutes to loosen the flesh. Chemical bathing (e.g., brining) the skins with flesh on means losing some of the belly meat for retail products like fish dip, cat food, and the like. This first chemical bathing (e.g., brining) step with meat still on the skin also significantly lowers the chance of tearing holes in the skin and thus maximizes the more valuable product from the lionfish—the leather.

Figure 4A:
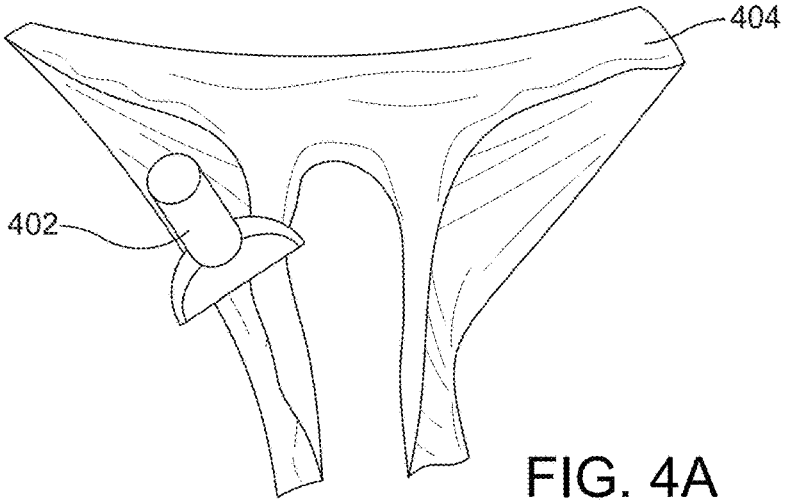
FIG. 4A-4C illustrate defleshing an example lionfish in accordance with the present disclosure.
Figure 4B:
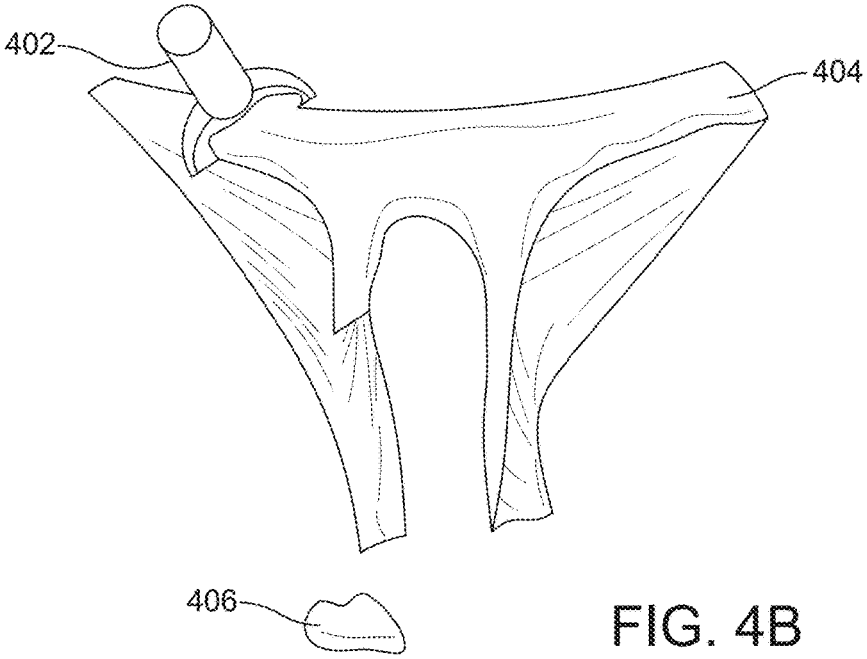
Figure 4C:
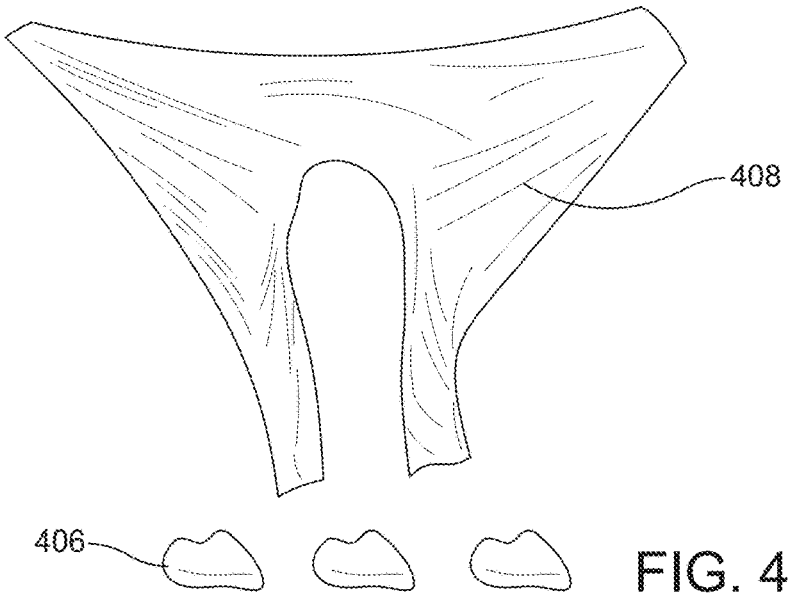

FIGS. 4A, 4B, and 4C demonstrate the de-fleshing of the skins. In FIG. 4A, a scraper 402 such as a high-friction fabric, hard-edge, knife, or scoop may be pushed across the skin with remnant flesh attached 404 against a clean, flat surface. Each such fish skin may be laid out and the inside of the skin may be scraped clean of flesh until there is none left. FIG. 4B shows some of the detached flesh 406 removed from the inside of the skin. FIG. 4C shows a clean skin 408 with all flesh removed. Care must also be taken not to enlarge any of the natural holes, for instance at the anus and anal spines of the fish.

After de-fleshing, a second brining soak is used with the same solution strength as the first brining soak (e.g., at least 500 g halophile-free salt per liter of water) to create a chemical brine. The skins are soaked in the chemical brine for a few hours with occasional stirring.

After this second brining step, the skins may be dried (e.g., dry salted, air dried, mechanically dried, etc.), for example, or wet salted. Fine-grained salt may be used to cover both sides of each skin. The skins may be placed on a rack to dry (e.g., 4-6 days). Other salting techniques may be used.

Tanning Steps

Removed fish skin may be subjected to one or more tanning processes. An outline of an example tanning process is shown in Table 2 below. However, additional or fewer steps may be used in any given tanning process.

TABLE 2

Tanning Steps

| Step | Notes |
|---|---|
| Soak | Cleans, hydrates, removes salt |
| Alkaline soak | Degreasing agent cleans skins and removes salt |
| Liming soak | |
| Deliming | Washes out lime |
| Pickling | Adds salt to protect from acid swelling |
| First tanning | $1^{st}$ tanning agent |
| Basification | pH increased |
| Second tanning/Re-tanning | $2^{nd}$ tanning agent |
| Dyeing | Adds color (optional) |
| Fatliquoring | Moisturizes leather, enhances lifetime & flexibility |
| Water Resistance Treatment | Increases water resistance (optional) |
| Tacking & Drying | Removes creases |
| Finishing | (optional) |

As an illustrative example, when one or more skins, or a threshold number of skins have been gathered and pre-processed, the tanning process itself may begin. A tanning process may comprise soaking the removed skin in water. Such soaking may be in a barrel or vessel, for example. The soaking process may clean the skins, hydrate the skins, and/or may remove salt used for a pre-tanning salting step. A tanning process may comprise an alkaline soaking step. The alkaline soak may use degreasing agents to finish cleaning the skins and removing the salt. A tanning process may comprise a liming soak which may increase the pH of the solution. Stronger chemicals may be added at this stage to enhance degreasing, if needed. At this step in particular, the skins are chemically very fragile. A tanning process may comprise a deliming step which may remove the lime (calcium) and starts to lower the pH. A tanning process may comprise a pickling step which may add acid to continue reducing the pH. A tanning process may comprise subjecting the skin to a first tanning agent. As an example, the first tanning agent may be introduced to the chamber with the skins and allowed to fully penetrate into the collagen matrix of the skins. The pH may be adjusted (e.g., raised) in a process called basification. The skin is now chemically leather.

A second tanning agent may be introduced after the first tanning agent. The second tanning agent may be the same or different from the first tanning agent. As an example, the second tanning agent may be different than the first tanning agent. One or both of the first tanning agent or the second tanning agent may comprises a vegetable tanning agent, a chromium tanning agent, a synthetic tanning agent, a brain tanning agent, or an oil tanning agent, or a combination thereof.

A dyeing step may be employed to alter or adjust the color of the leather. A fatliquoring step may add calibrated amounts of fats and oils to the leather, moisturizing it, increasing its flexibility, and enhancing its longevity. Next, an optional water resistance treatment may be used by chemically treating the leather to increase its water resistance properties. The skins may be secured to a corkboard or other surface to stretch them tight and remove creases while the leather is drying. Additionally or alternatively, finishing steps may be applied. Finishes can be used to enhance or add properties (e.g., durability, softness) or alter the appearance (color, texture). Finishing may be used for precise color matching, enhanced water resistance, texture control, etc.

Figure 8:
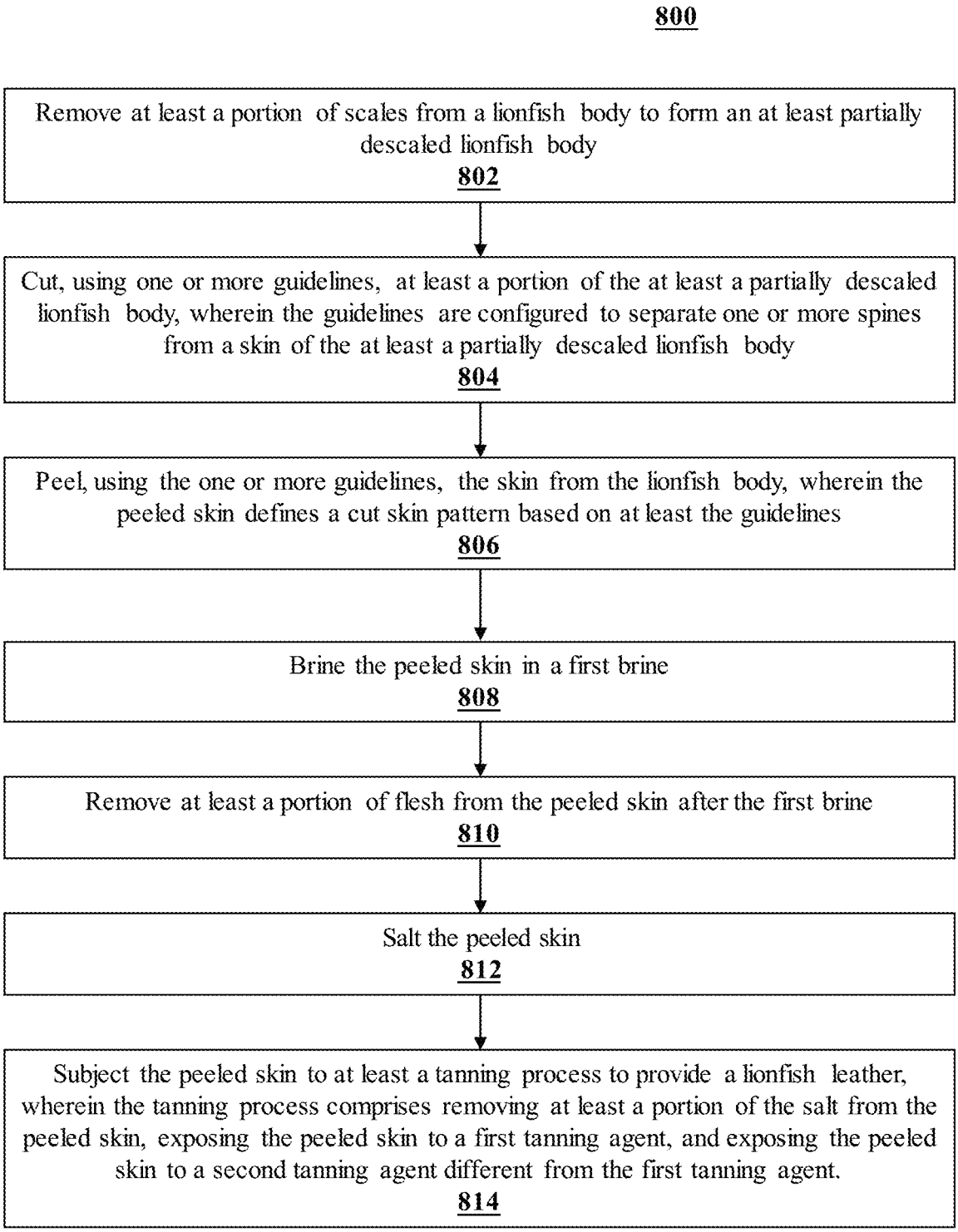
FIG. 8 illustrates an example method in accordance with the present disclosure.

FIG. 8 illustrates an example method 800 of making fish leather such as lionfish leather. At 802, the method includes removing at least a portion of scales from a lionfish body to form an at least partially descaled lionfish body. At 804, the method includes cutting, using one or more guidelines, at least a portion of the at least partially descaled lionfish body. As an example, the guidelines may be configured to separate the skin from the body and/or separate one or more spines from a skin of the at least partially descaled lionfish body. At 806, the method 800 includes peeling, using the one or more guidelines, the skin from the lionfish body. As an example, the peeled skin defines a cut skin pattern based on at least the guidelines. At 808, the method 800 includes brining the peeled skin in a first brine. At 810, the method 800 includes removing at least a portion of flesh from the peeled skin after the first brine. At 812, the method includes salting such as dry salting or wet salting the peeled skin. At 814, the method 800 includes subjecting the peeled skin to at least a tanning process to provide a lionfish leather. As an example, the tanning process may include removing at least a portion of the salt from the peeled skin, exposing the peeled skin to a first tanning agent, and exposing the peeled skin to a second tanning agent different from the first tanning agent.

Figure 9:
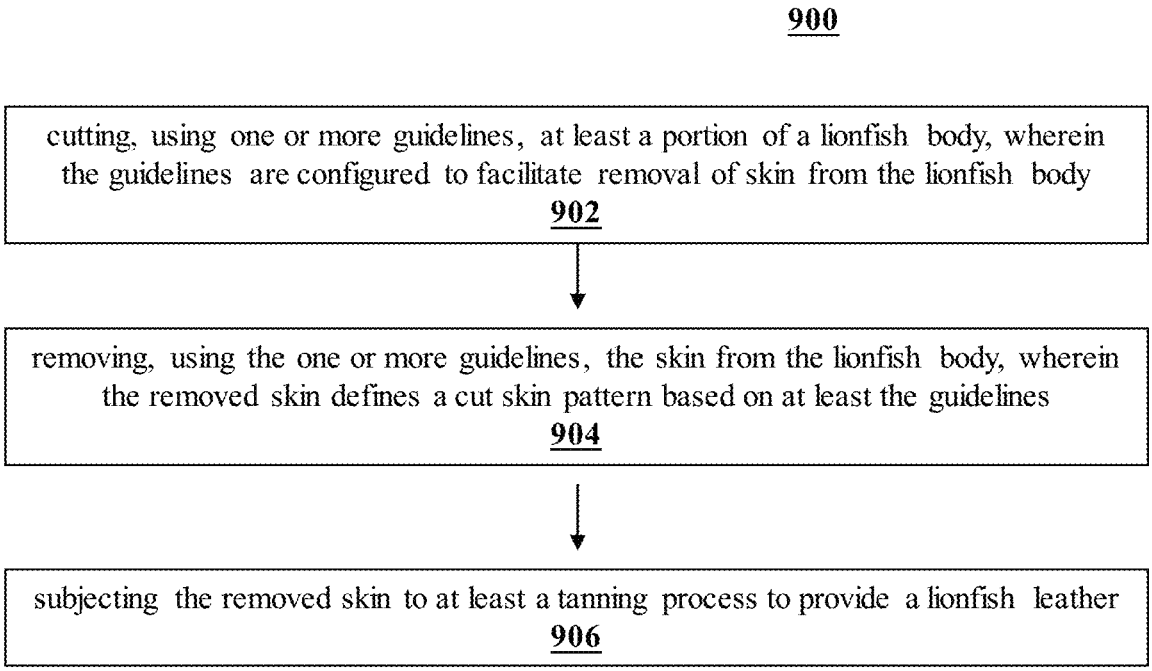
FIG. 9 illustrates an example method in accordance with present disclosure.

FIG. 9 illustrate an example method 900 of making lionfish leather. The method of making fish leather such as lionfish leather includes cutting, using one or more guidelines, at least a portion of a lionfish body or other fish, at 902. As an example, the guidelines may be configured to facilitate removal of skin from the lionfish body. At 904, the method 900 may include removing, using the one or more guidelines, the skin from the lionfish body. As an example, the removed skin defines a cut skin pattern based on at least the guidelines. At 906, the method 900 includes subjecting the removed skin to at least a tanning process to provide a lionfish leather. As an example, the tanning process may include exposing the removed skin to a first tanning agent and exposing the removed skin to a second tanning agent different from the first tanning agent.

Traditional tanneries are set up for large hides. By engaging with a skin that is small relative to typical tanned hides, novel methods and techniques have been developed to process and tan the skins. In some instances, new equipment has been created or traditional equipment has been heavily modified to accommodate the size of the skins. These modifications mean that the equipment is prevented (temporarily or permanently) from processing larger or normal-sized skins. Thus the equipment can effectively only be used to process these smaller skins.

Lionfish skin leather prepared in accordance with the present disclosure has improved performance characteristics over conventional leather formed from animal hides. As an illustrative example, samples of lionfish skin leather prepared in accordance with the present disclosure exhibited a specific tensile strength of greater than 110 N/mm, greater than 111 N/mm, greater than 112 N/mm, greater than 113 N/mm, greater than 114 N/mm, greater than 115 N/mm, greater than 116 N/mm, greater than 117 N/mm, between 110 N/mm and 117 N/mm, between 111 N/mm and 117 N/mm, between 112 N/mm and 117 N/mm, between 113 N/mm and 117 N/mm, between 114 N/mm and 117 N/mm, between 115 N/mm and 117 N/mm, and/or between 116 N/mm and 117 N/mm, as measured using ASTM 2209. Of note, samples of lionfish skin leather prepared in accordance with the present disclosure exhibited a specific tensile strength greater than kangaroo leather (e.g., 109 N/mm) as measured using ASTM 2209.

Figure 5:
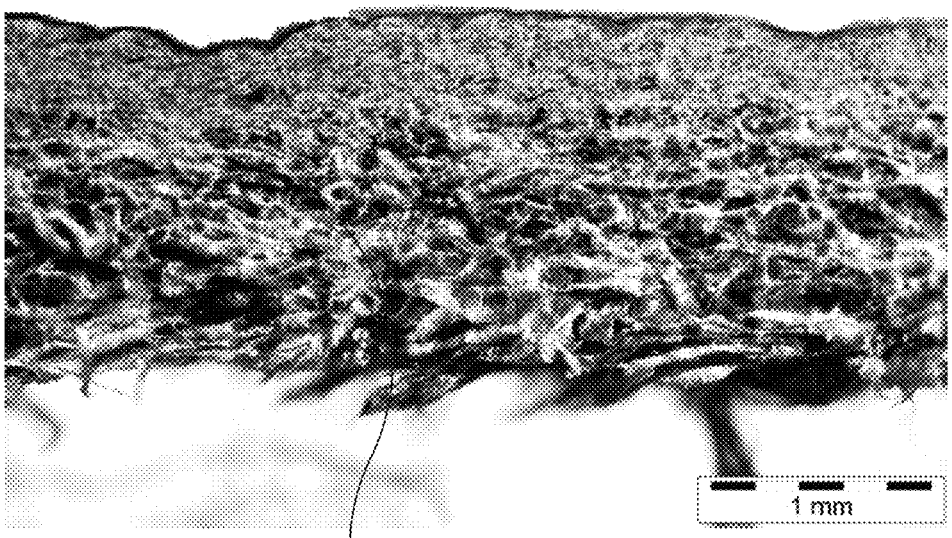
FIG. 5 illustrates a cross-section of example bovine leather in accordance with the prior art.
Figure 6:
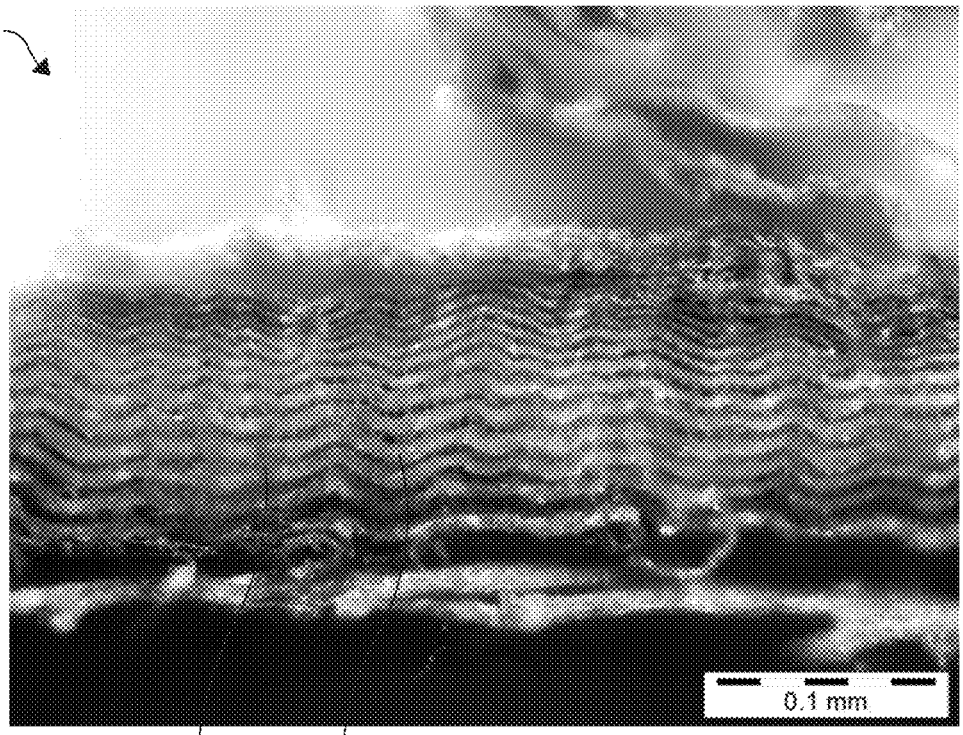
FIG. 6 illustrates a cross-section of example lionfish leather prepared in accordance with the present disclosure.

FIG. 5 shows the collagen matrix 502 in bovine leather 500. No discernable pattern is visible. This lack of patterning is also applicable for all mammal leather. In contrast FIG. 6 shows the collagen matrix in lionfish leather 600 prepared in accordance with the present disclosure. Note the change in scale between the two figures. The mammal leather is shown with a scale of 1 mm whereas the lionfish leather is shown at a scale $1/10^{th}$ the size of 0.1 mm because it is typically much thinner than mammal leather. The lionfish leather shows a collagen matrix 602, 604 which is woven together in tightly packed layers (the light bands 602 and dark bands 604 shown in FIG. 6). These layers run perpendicular to each other in a "cross-hatching", resulting in a remarkably high specific tensile strength for the thickness (e.g., measured using ASTM 2209). Such characteristics allow lionfish leather to be used for various applications where a thinner, but strong leather is useful.

Figure 7:
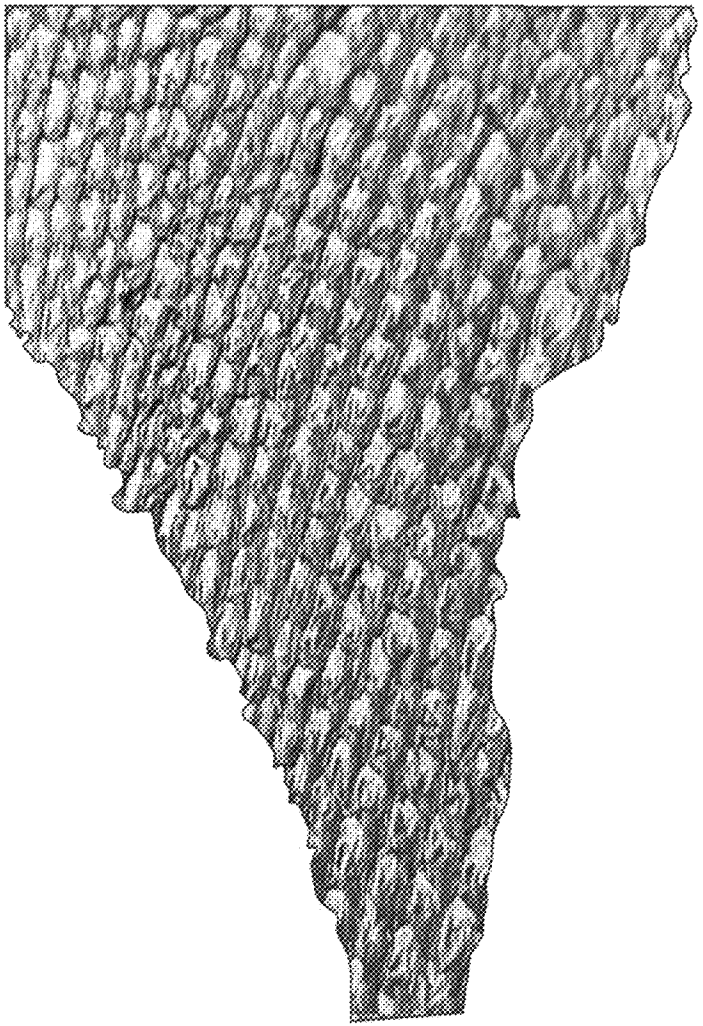
FIG. 7 illustrates an example of fish leather prepared in accordance with the present disclosure.

FIG. 7 shows some examples of lionfish leather substrate prepared in accordance with the present disclosure. As used herein, substrate may reference a portion of material, a planar sample, a rolled material, or other material that is capable of being formed into articles, such as with conventional leather materials. Example articles may include use of the inventive lionfish leather where conventional leathers have been used. Additional applications may benefit from the increased tensile strength of the inventive lionfish leather.

The present disclosure comprises at least the following aspects:

Aspect 1: A leather substrate made from a lionfish skin.

Aspect 2: A leather substrate made from fish skin and exhibiting a specific tensile strength of greater than 109 N/mm as measured using ASTM 2209.

Aspect 3: The leather substrate of aspect 2, wherein the fish skin comprises lionfish skin.

Aspect 4: The leather substrate of aspect 2, wherein the fish skin consists essentially of lionfish skin.

Aspect 5: The leather substrate of aspect 2, wherein the fish skin consists of lionfish skin.

Aspect 6: A method of making lionfish leather, the method comprising: removing at least a portion of the scales from a lionfish body to form a descaled lionfish body; cutting one or more guideline cuts in the descaled lionfish body; peeling, using the one or more guideline cuts, a skin from the lionfish body; and tanning the skin to provide a lionfish leather.

Aspect 7: The method of aspect 6, wherein removing scales from a lionfish body is implemented using a water jet.

Aspect 8: The method of aspect 7, wherein the water jet is used perpendicular to the direction of overlapping scales.

Aspect 9: The method of aspect 7, wherein the water jet is used in the same direction as the overlapping scales.

Aspect 10: The method of aspect 6, wherein the guideline cuts are based on a half skin cut.

Aspect 11: The method of aspect 6, wherein the guideline cuts are based on a pants cut.

Aspect 12: The method of aspect 6, wherein the guideline cuts are based on a triangle cut.

Aspect 13: The method of aspect 6, wherein the guideline cuts are configured to maximize a surface area of the peeled skin.

Aspect 14: A method of harvesting lionfish, the method comprising: offering a hunting incentive for the hunting of lionfish, wherein the hunting incentive comprises a weight component and a shot location component; receiving lionfish from one or more hunters; sorting the received lionfish based at least on body size and shot location; and rendering payment to the one or more hunters based on the hunting incentive and the received lionfish.

In certain aspects, one or more steps of the method of aspect 14 may be executed via a computer system or computer readable medium. A computing device may be in data communication and computer readable medium that, when executed, causes the computing device to execute one or more steps of methods herein.

Aspect 15: The method of aspect 14, further comprising: removing scales from a lionfish body of one or more of the received lionfish; cutting one or more guideline cuts in the descaled lionfish body; peeling, using the one or more guideline cuts, a skin from the lionfish body; and tanning the skin to provide a lionfish leather.

Aspect 16: The method of aspect 15, wherein the guideline cuts are based on a half skin cut.

Aspect 17: The method of aspect 15, wherein the guideline cuts are based on a pants cut.

Aspect 18: The method of aspect 15, wherein the guideline cuts are based on a triangle cut.

Aspect 19: The method of aspect 15, wherein the guideline cuts are configured to maximize a surface area of the peeled skin.

Aspect 20: A method for protecting coral reefs from over-predation by lionfish, the method comprising: determining a location for lionfish meeting a certain density threshold; providing a hunting incentive for hunting of lionfish at or near the location, wherein the hunting incentive comprises a weight component and a shot location component; receiving lionfish from one or more hunters; sorting the received lionfish based at least on body size and shot location; and rendering payment to the one or more hunters based on the hunting incentive and the received lionfish.

In certain aspects, one or more steps of the method of aspect 20 may be executed via a computer system or computer readable medium. A computing device may be in data communication and computer readable medium that, when executed, causes the computing device to execute one or more steps of methods herein.

Aspect 21: A method for creating lionfish skin leather, the method comprising: harvesting a lionfish by spear fishing; removing scales from a body of the lionfish; cutting a skin of the body of the lionfish to maximize a skin surface area; subjecting the skin to a tanning process.

Aspect 22: A method for creating leather from lionfish skin, the method comprising: cutting a skin of a lionfish in a pattern which maximizes a skin surface area; peeling the skin from a body of the fish; treating the skin to form a leather substrate.

Aspect 23: The method of aspect 22, wherein the treating the skin comprises: soaking the skin in a first brine solution; de-fleshing the skin; soaking the skin in a second brine solution; and tanning the skin.

Aspect 24: The method of aspect 22, wherein the pattern is based on a half skin cut.

Aspect 25: The method of aspect 22, wherein the pattern is based on a pants cut.

Aspect 26: The method of aspect 22, wherein the pattern is based on a triangle cut.

Aspect 27: A leather substrate formed from lionfish skin.

Aspect 28: The leather substrate of aspect 27, wherein the lionfish skin is configured as a half skin cut.

Aspect 28: The leather substrate of aspect 27, wherein the lionfish skin is configured as a pants cut.

Aspect 29: The leather substrate of aspect 27, wherein the lionfish skin is configured as a triangle cut.

Aspect 30: A leather substrate formed from fish skin configured as a triangle cut.

Aspect 31: The leather substrate of aspect 30, wherein the fish skin comprises lionfish skin.

Aspect 32: A fish skin configured as a triangle cut.

Aspect 33: The fish skin of aspect 32, wherein the fish skin comprises lionfish skin.

Aspect 34: A leather substrate formed from a small fish having a whole body weight of less than or equal to 3.51b.

Aspect 35: A leather substrate formed from a small fish having a whole body weight of less than or equal to 3.41b.

Aspect 36: A leather substrate formed from a small fish having a whole body weight of less than or equal to 3.31b.

Aspect 37: A leather substrate formed from a small fish having a whole body weight of less than or equal to 3.21b.

Aspect 38: A leather substrate formed from a small fish having a whole body weight of less than or equal to 3.11b.

Aspect 39: A leather substrate formed from a small fish having a whole body weight of less than or equal to 3.01b.

The leather substrate of any one of aspects 34-39, wherein the small fish comprises lionfish.

Although shown and described in what is believed to be the most practical and preferred embodiments, it is apparent that departures from specific designs and methods described and shown will suggest themselves to those skilled in the art and may be used without departing from the spirit and scope of the invention. The present invention is not restricted to the particular constructions described and illustrated but should be constructed to cohere with all modifications that may fall within the scope of the appended claims.

What is claimed is:

1. A method of making lionfish leather, the method comprising:

removing at least a portion of scales from a lionfish body to form an at least partially descaled lionfish body;

cutting, using one or more guidelines, at least a portion of the at least partially descaled lionfish body, wherein the guidelines are configured to facilitate removal of skin from the at least partially descaled lionfish body;

peeling, using the one or more guidelines, the skin from the at least partially descaled lionfish body, wherein the peeled skin defines a cut skin pattern based on at least the guidelines;

brining the peeled skin in a first brine;

removing at least a portion of flesh from the peeled skin after the first brine;

salting the peeled skin; and subjecting the peeled skin to at least a tanning process to provide a lionfish leather, wherein the tanning process comprises exposing the peeled skin to a first tanning agent and exposing the peeled skin to a second tanning agent different from the first tanning agent.

2. The method of claim 1, wherein the cutting is configured to result in a half skin cut pattern.

3. The method of claim 1, wherein the cutting is configured to result in a pants cut pattern.

4. The method of claim 1, wherein the cutting is configured to result in a triangle cut pattern.

5. The method of claim 1, wherein the cutting is configured to maximize a surface area of the peeled skin.

6. The method of claim 1, wherein the first tanning agent comprises a vegetable tanning agent, a chromium tanning agent, a synthetic tanning agent, a brain tanning agent, or an oil tanning agent, or a combination thereof.

7. The method of claim 1, wherein the second tanning agent comprises a vegetable tanning agent, a chromium tanning agent, a synthetic tanning agent, a brain tanning agent, or an oil tanning agent, or a combination thereof.

* * * * *